US007854397B2

(12) United States Patent
Colavito et al.

(10) Patent No.: US 7,854,397 B2
(45) Date of Patent: Dec. 21, 2010

(54) LONG THROW SHOTCRETE NOZZLE

(75) Inventors: Dominick M. Colavito, Bangor, PA (US); Ronald Schmidt, Macungle, PA (US); Richard C. Griffin, Mount Bethel, PA (US); Bernard D. Gist, Roseto, PA (US); Cleve Michael Ruston, McMinnville, OR (US)

(73) Assignee: Specialty Minerals (Michigan) Inc., Bingham Farms, MI (US)

( * ) Notice: Subject to any disclaimer, the term of this patent is extended or adjusted under 35 U.S.C. 154(b) by 0 days.

(21) Appl. No.: 11/367,791

(22) Filed: Mar. 3, 2006

(65) Prior Publication Data

US 2006/0163384 A1 Jul. 27, 2006

Related U.S. Application Data

(63) Continuation-in-part of application No. 11/040,210, filed on Jan. 21, 2005.

(51) Int. Cl.
*B05B 1/28* (2006.01)

(52) U.S. Cl. ..... 239/290; 239/589

(58) Field of Classification Search ..... 239/589, 239/592, 398, 418, 419, 424, 424.5, 427, 239/429, 290, 291, 416.4, 416.5
See application file for complete search history.

(56) References Cited

U.S. PATENT DOCUMENTS

| | | | | |
|---|---|---|---|---|
| 1,051,672 A | | 1/1913 | Boudreaux | |
| 2,419,410 A | | 4/1947 | Maurer | |
| 2,625,433 A | * | 1/1953 | Vose | 239/119 |
| 2,672,190 A | * | 3/1954 | Schumann | 431/175 |
| 3,462,083 A | | 8/1969 | Kautz | |
| 3,478,963 A | | 11/1969 | Winn, Jr. | |
| 3,764,069 A | * | 10/1973 | Runstadler, Jr. et al. | 239/8 |
| 3,899,131 A | | 8/1975 | Mester et al. | |
| 3,931,959 A | | 1/1976 | Truman | |

(Continued)

FOREIGN PATENT DOCUMENTS

DE 19948779 A1 4/2001

(Continued)

OTHER PUBLICATIONS

I. Leon Glassgold, Refractory Shotcrete—Current State-of-the-Art, Shotcrete Classics, Summer 2002, 24-32.

*Primary Examiner*—Davis Hwu
(74) *Attorney, Agent, or Firm*—Derek S. Jessen; Leon Nigohosian, Jr.

(57) ABSTRACT

An improved apparatus for the gunning of a material is provided having a nozzle with an inner passage defined by an inner tubular member having an inlet end into which a wetted material is to be introduced and an outlet end from which the material is to be sprayed. An outer tubular member is disposed around the inner tubular member defining an outer passage between the inner and outer tubular members. A compressed gas is passed through the outer passage and impinged on the wetted material exiting the inner passage to better control the spray pattern of the wetted material. The inner tubular member extends out beyond the outlet end of the outer tubular member and the inner surface of the outer tubular member and the outer surface of the inner tubular member near the outlet end are chamfered to provide an optimal attitude for the impinging air.

17 Claims, 6 Drawing Sheets

U.S. PATENT DOCUMENTS

| | | | |
|---|---|---|---|
| 4,042,223 | A | 8/1977 | Langhammer et al. |
| 4,094,946 | A | 6/1978 | Finkensiep et al. |
| 4,116,388 | A | 9/1978 | Trozzi |
| 4,230,271 | A | 10/1980 | Marcault |
| 4,258,544 | A | 3/1981 | Gebhart et al. |
| 4,368,219 | A | 1/1983 | Nagata et al. |
| 4,370,944 | A | 2/1983 | Nagata et al. |
| 4,562,961 | A | 1/1986 | Guenard et al. |
| 4,638,945 | A | 1/1987 | Toda et al. |
| 4,768,710 | A | 9/1988 | Sperber |
| 4,779,798 | A | 10/1988 | Natolino et al. |
| 4,981,731 | A | 1/1991 | Yorita et al. |
| 5,188,290 | A | 2/1993 | Gebauer et al. |
| 5,188,296 | A | 2/1993 | Duez et al. |
| 5,452,856 | A | 9/1995 | Pritchard |
| 5,486,676 | A | 1/1996 | Aleshin |
| 5,628,940 | A | 5/1997 | Allison |
| 5,766,689 | A | 6/1998 | Ono |
| 5,795,594 | A | 8/1998 | York et al. |
| 5,869,145 | A | 2/1999 | Iwasaki et al. |
| 5,976,632 | A | 11/1999 | Gerber et al. |
| 5,979,798 | A | 11/1999 | Hall et al. |
| 6,082,637 | A | 7/2000 | Ludwig |
| 6,158,676 | A | 12/2000 | Hughes |
| 6,217,654 | B1 | 4/2001 | Mauchle et al. |
| 6,277,446 | B1 | 8/2001 | Tanaka et al. |
| 6,592,048 | B2 | 7/2003 | Motoki et al. |
| 6,613,307 | B1 | 9/2003 | Cooper |

FOREIGN PATENT DOCUMENTS

| | | |
|---|---|---|
| DE | 10017135 A1 | 12/2001 |
| EP | 1 223 399 | 7/2002 |
| JP | 50-24660 | 7/1975 |
| JP | 52-139365 | 10/1977 |
| JP | 356087450 | 7/1981 |
| JP | 62-049964 | 3/1987 |
| JP | 5-76546 | 10/1993 |
| JP | 10316478 | 5/1997 |
| JP | 2000356475 | 6/1999 |
| JP | 11-197556 | 7/1999 |
| JP | 2000-189852 | 7/2000 |
| SU | 0670705 U | 6/1979 |
| SU | 1686195 | 7/1991 |

* cited by examiner

LONG THROW SHOTCRETE NOZZLE

RELATED APPLICATIONS

This application is a continuation-in-part of co-pending application Ser. No. 11/040,210, filed on Jan. 21, 2005.

FIELD OF THE INVENTION

The present invention relates to an apparatus for applying material and more particularly to a gunning device for gunning monolithic refractories.

BACKGROUND

Gunning devices that project a material onto a target substrate for producing or repairing of refractory linings are generally known. Two widely used gunning methods for fabricating and repairing refractory linings are known as the gunnite-type and shotcrete-type gunning methods. Unlike other casting methods, these gunning methods require no framework for casting refractory linings and allow for easy application even on irregular shapes or where frameworking is difficult to construct. Accordingly, gunning methods have been widely used in fabricating and repairing refractory linings, particularly, in furnaces such as a blast furnace, hot stove, electric furnace, converter, ladle, tundish, basic oxygen furnace and reheating furnace.

In a gunnite method, also known as dry-mix method, a dry powdery material to be "gunned" is pneumatically fed through a transporting hose to a nozzle assembly where a liquid, such as water, is added to produce a wet, highly viscous gunning material with good adhesive properties. The gunning material is projected through the nozzle assembly so that the material adheres and cures on the furnace wall portion, whereby a refractory furnace lining is fabricated or repaired. The gunnite application method requires no premixing of material with the liquid and can therefore be carried out rapidly and on short notice and clean-up of equipment is minimal. An additional advantage over other methods of fabricating or repairing furnace linings include not having to use a lining mold, thereby enabling cost reduction and improving working efficiency and enables the repair of both hot and cold furnace linings. However, one disadvantage of the gunnite method is that it is difficult to completely wet and thoroughly mix the material and water stream as it is transported through the application gunning lance, pipe or nozzle. This is particularly true for short (less than about 5 feet) gunning pipes. In these situations, a lack of thoroughness in mixing results in less than optimum and desirable applied mass homogeneity and density, an increase in material waste due to rebounding aggregate and poor mass adhesion and often excessive material pipe drip. Additionally, when a directional change in the flow of the gunning material is required, the material tends to exit the nozzle in a "split" non-homogenous stream where part of the stream is very dry while the other part is overly wet, a phenomenon that is independent of any attempted water control. A problem associated with an overly dry or poorly wet gunning material that is gunned onto the object target, is that a portion of the material does not adhere to the substrate and causes a loss of deflected particles (known as "rebound") which lowers the adhesion percentage of the gunning material to the furnace wall, thus affecting the quality and durability of a refractory furnace mass. To, overcome the problems associated with the gunnite methods, shotcrete-gunning methods were developed.

Shotcrete gunning methods, also known as wet-mix method, produce refractories having a more uniform quality and better physical properties than obtained by the gunnite method and generally are used for producing high density, monolithic structures. In the shotcrete method, a gunning material is produced by mixing a dry material with liquid, such as water, in a separate mixing device prior to delivery to a gunning device. The dry powdery material is pre-wet with the liquid in a mixer and then pumped by a delivery pump through a transfer hose to a gunning device which projects the gunning material to a target using compressed air. Usually, a setting agent is added to the gunning material at the nozzle prior to the gunning material being projected onto a furnace wall structure.

The shotcrete gunning method is not without its attendant drawbacks, however, in that it is necessary to mix the dry material with the liquid in a separate vessel until a suitable consistency is obtained. Thus, a shotcrete gunning material is mixed before it is supplied by the delivery pump to a gunning device requiring additional equipment, e.g., mixer and delivery systems, and manpower, when compared with the dry-mix gunnite method. Moreover, it is important to accurately control the amount of liquid to the gunning material in the shotcrete gunning method to maintain the proper consistency. As a result, skill on the part of the shotcrete-mixer operator is required to maintain the correct amount of water for a desirable composition. If too little water is used, blocking or premature hardening of the gunning material may occur in the pump or delivery hose. Conversely, if an excessive amount of water is used, there can be separation of aggregates of coarse particles and fine powder which is contained in the gunning material to be sprayed causing uneven and poor quality refractory layers.

The conventional nozzles used in the shotcrete applications utilize a constricted nozzle tip generally made of flexible material such as polyurethane. The constricted conventional shotcrete nozzle tips are susceptible to blow-outs. Blow-outs occur when the wet-mix shotcrete aggregate material clogs the narrowing nozzle tip. Under the pressure of the wet-mix material being pumped out of the nozzle, the polyurethane nozzle tips blowup like a balloon and rupture, thus, blowing out substantial portion of the nozzle tip. Once the conventional nozzle tip is damaged by a blow-out, the shotcrete cannot be sprayed in controlled manner. The wet-mix shotcrete material will be ejected from the nozzle in uncontrolled shape and also excessive amount will be lost to dripping from the blown out nozzle tip.

In addition, the constricted shape of the conventional shotcrete nozzle tip, which is designed to control the spray pattern of the wet-mix shotcrete material and also to accelerate the velocity of the shotcrete material through Venturi effect, tends to wear through use. The worn-out nozzle tip then loses the ability to maintain proper spray pattern.

The foregoing illustrates limitations known to exist in present refractory coating methods and devices. Thus it is apparent that it would be advantageous to provide an alternative directed to overcoming one or more of the limitations set forth above. Accordingly an alternative apparatus for the gunning of a material is provided including the features more fully disclosed hereinafter.

SUMMARY

According to an embodiment, an apparatus for the gunning of a material is provided having a nozzle with an inner passage having an inlet end into which a wetted material is to be introduced and an outlet end from which the material is to be sprayed. The wetted material may be a wet-mix material or dry-mix material. An outer passage is disposed around the inner passage and in fluid communication therewith and has an inlet end for introducing a gas to be passed through the outer passage and impinged on the wetted material passing through the inner passage, thus constricting the material as it exits the nozzle.

According to another embodiment, also provided is an apparatus for gunning of dry-mix material having a material delivery hose for the dry-mix material. A water inlet in fluid communication with the material delivery hose provides water to wet the dry-mix material and a nozzle outputs the wetted material. A mixing chamber is disposed intermediate and in fluid communication with the material delivery hose and the nozzle and has at least one inlet for introducing a mixing gas.

According to another embodiment, an improved gunning nozzle is provided. The nozzle can be used in wet-mix applications as well as dry-mix applications. The nozzle has an inner tubular member defining an inner passage and an outer tubular member disposed around the inner tubular member defining an outer passage between the two tubular members. The inner passage has an inlet end into which a wetted material is to be introduced and an outlet end from which the wetted material is to be sprayed. The outer passage has an inlet end for introducing a gas to be passed through the outer passage and an outlet end from which the gas exits and impinges on the wetted material exiting the inner passage. In this embodiment, the outlet end of the inner tubular member extends beyond the outlet end of the outer tubular member and the outer surface of the inner tubular member and the inner surface of the outer tubular member at the outlet end are chamfered at same angle.

The various embodiments of the gunning nozzles disclosed herein can be used for gunning of refractory materials as well as various other materials that can be applied by gunning. Some examples are non-refractory structural concrete used in bridges and tunnels and fire proofing material for coating structural beams in buildings.

The foregoing and other aspects will become apparent from the following detailed description of the invention when considered in conjunction with the accompanying drawing figures.

BRIEF DESCRIPTION OF THE DRAWINGS

The invention will be better understood from the following detailed description of an exemplary embodiment thereof in conjunction with the accompanying drawing in which.

All figures are schematic and they do not illustrate the dimensions in actual proportions. Like reference numerals are used to denote like parts throughout the various figures.

DETAILED DESCRIPTION

Figure 1:
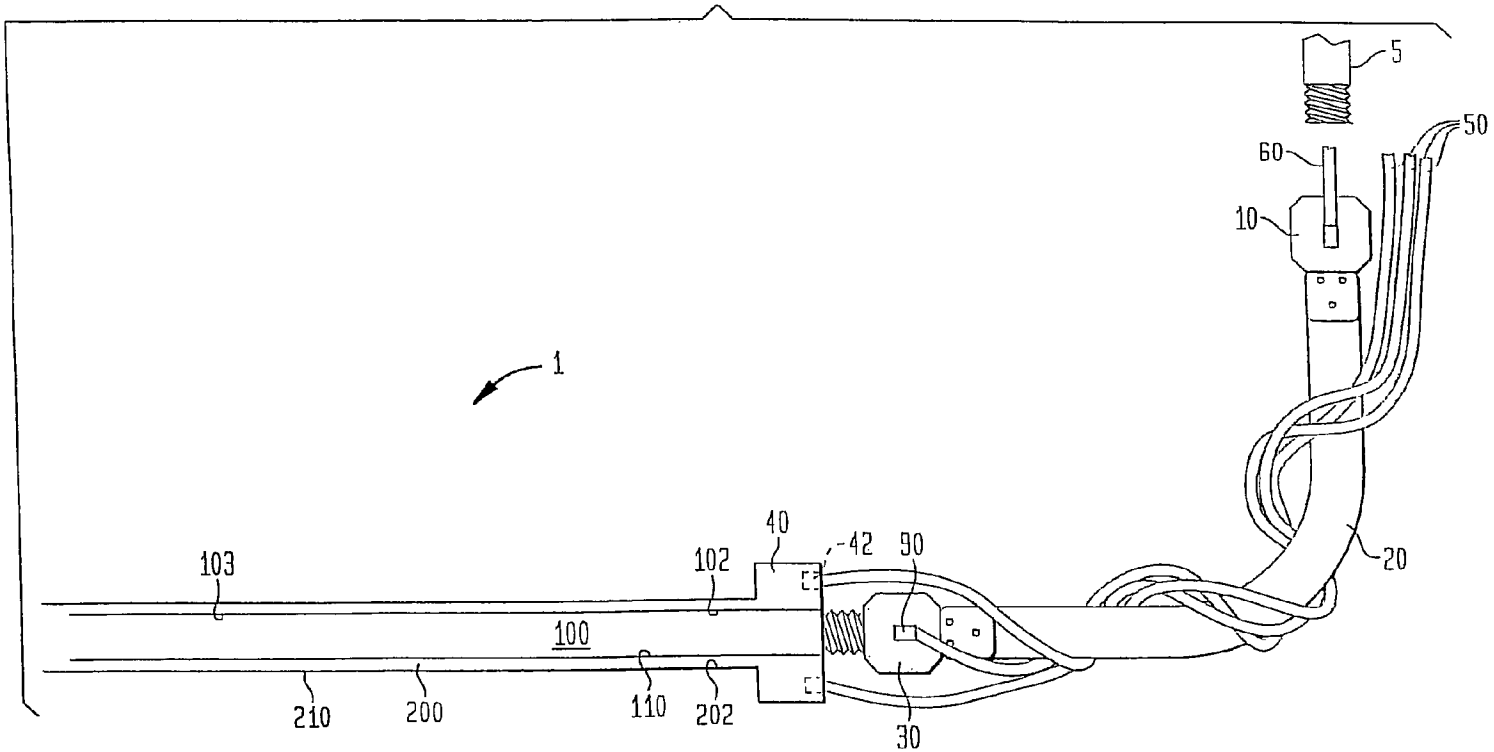
FIG. 1 is a partial sectional view of the gunning device with one nozzle embodiment according to the present invention.

As used herein, the term "drip" refers, generally, to the phenomenon that results when wet product fines separate out from the stream of a gunning material. More specifically, it includes, but is not limited to, a viscous "putty-like" build-up at the tip of the discharge end of the nozzle assembly that can fall down from the gunning material being projected onto the target substrate, thus adversely affecting the quality of the application. Also included in this definition is a second type of "drip" phenomenon which results when fines settle out from a gunning nozzle stream along the inside wall of the nozzle assembly, producing a less viscous "drip" that is projected from the nozzle assembly at a lower velocity such that it creates material waste since it does not reach the target substrate.

As used herein the term "rebound" refers, generally, to the occurrence when a gunning material does not adhere to the target substrate, e.g., because it is poorly wet or not entrapped by more fully wet gunned mass. This also includes, but is not limited to, instances of aggregate deflection which generally occurs when aggregate contained in the material bounces off a targeted surface and/or when the gunning material falls off of the target substrate during or immediately after the gunning material is applied to the targeted substrate causing a lower adhesion percentage of the gunning material to the furnace wall.

According to an embodiment of the present invention a gunning device is provided for applying materials such as monolithic refractories to a surface such as an interior wall surface of a furnace, preferably while the furnace is still heated. In particular, it has been discovered that the embodiment of the gunning device of the present invention for dry-mix gunning application increases the degree and thoroughness of contact between the powdery material and the water and improves irregular and/or poor mixing and improved the consolidation of the gunning stream, thereby reducing "drip," the occurrence of a "split" non-homogenous stream, and "rebound." By reducing these problems, the adhesion percentage of the dry-mix gunning material is improved to produce a lining body having improved density and improved strength, relative to conventional application equipment and methods, thereby enhancing the quality and durability of an applied mass.

Additionally, the present invention provides an improved nozzle for a wet-mix gunning device that conveys the gunning material onto a target surface with improved efficiency. In particular, it has been discovered that the gunning device of the present invention improved the consolidation of the gunning stream, thereby reducing "drip" in gunning of wet-mix materials.

The invention is best understood by reference to the accompanying drawings in which like reference numbers refer to like parts. It is emphasized that, according to common practice, the various dimensions of the apparatus and the associated component parts as shown in the drawings are not to scale and have been enlarged for clarity.

Referring now to the drawings, shown in FIG. 1, is an apparatus for the gunning of a dry-mix material including a nozzle 1 having an inner passage 100 having an inlet end 102 into which a wetted material is to be introduced and an outlet end 103 from which the material is to be gunned. An outer passage 200 is disposed around the inner passage 100 that is in fluid communication therewith, the outer passage 200 having an inlet end 202 for introducing a gas to be passed through the outer passage 200 and impinged on the wetted material passing through the inner passage 100. The inner passage 100 is preferably defined by an inner tubular member 110 and the outer passage 200 is defined by an outer tubular member 210 disposed around the inner tubular member 110.

Sequentially attached to the nozzle 1 are a mixing chamber 30, a dry-mix material delivery hose 20, and a water inlet 10, all of which are in fluid communication and through which a material is fed, preferably, being supplied pneumatically by a transporting pipe 5 that attaches to the water inlet 10. Water inlet 10 is connected to a water source 60 that provides water to wet the dry-mix material to form a "gunning" material that is passed through the material delivery hose 20 to mixing chamber 30.

Mixing chamber 30 is disposed intermediate to and in fluid communication with material delivery hose 20 and nozzle 1. More specifically, mixing chamber 30 is in fluid communication with the inlet end 102 of the inner passage 100 of nozzle 1 and a source of mixing gas. The mixing gas is preferably provided by at least one gas inlet 90 for injecting gas into the flow of the gunning material. More preferably, the gas inlet 90 includes a ring of horizontally oriented gas injection ports which impinge a flow onto the material to cause additional mixing of the material and water.

In operation, the pneumatically driven gunning material exits mixing chamber 30 and is projected into inlet end 102 and out of outlet end 103 of inner tubular member 110 onto a target substrate (not shown). Preferably, the inner tubular member 110 defining inner passage 100 is from about 12 inches to about 36 inches in length and is in fluid communication with the mixing chamber 30 and, preferably, attached by a threaded nipple as shown. Preferably, the outer passage 200 is an annular space that is defined by the inner tubular member 110 being disposed concentrically within the outer tubular member 210.

According to a first nozzle embodiment, outer tubular member 210 defining the outer passage 200 is longer than the inner tubular member 110 defining the inner passage 100, as shown in FIG. 1. The outer tubular member 210 is located such that the outer passage 200 extends beyond the outlet end 103 of the inner tubular member 110, preferably, from about ¼ inch to about 12 inches.

Figure 2:
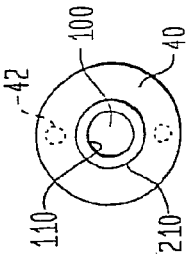
FIG. 2 is an end view of the outlet end of the nozzle shown in FIG. 1.

Preferably, nozzle 1 further comprises a hollow flange 40 disposed around the inlet end 102 of the inner passage 100. Shown in FIG. 2 is an end view of hollow flange 40 as viewed looking at the outlet end 103 of the inner tubular member 110. The hollow flange 40 includes at least one gas inlet 42 that connects the inlet end 202 of the outer passage 200 with a source of the gas to be impinged on the wetted material.

In this fashion, a controlled gas injection can be provided through the outer passage in which gas flows through the outer passage, reaches the outlet end, and acts to consolidate the stream of gunning material as it leaves the outlet end of the inner tubular member 110 allowing for lower material waste and better quality application. As shown in FIG. 1, preferably, pneumatic lines 50 are provided which supply a source of compressed gas, such as compressed air, to the gas inlets 42, 90.

Figure 3:
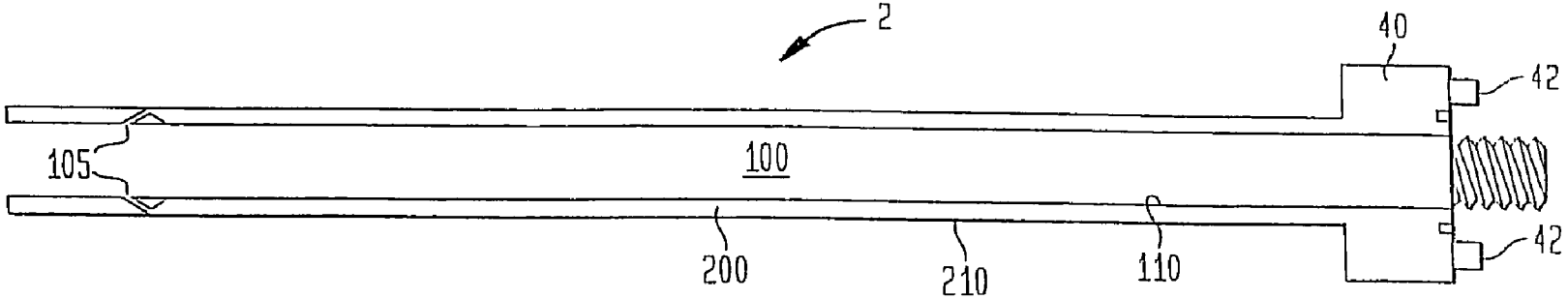
FIG. 3 is a sectional view of an alternate nozzle embodiment according to the present invention.
Figure 4:
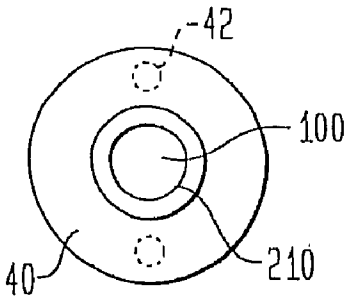
FIG. 4 is an end view of the outlet end of the nozzle of FIG. 3.

According to another embodiment of the present invention, shown in FIG. 3 is an alternate embodiment of a nozzle 2 according to the present invention, wherein the inner tubular member 110 comprises at least one opening 105 through and near its outlet end, thereby connecting the inner and outer passages of the nozzle. Preferably, at least one opening is at an angle from about 5 degrees to about 90 degrees with respect to a longitudinal axis of the inner tubular member 110 to force the gas being passed through the outer passage to be projected into the inner passage at an angle as it enters the stream of gunning material. In this fashion, the spray of the gunning material is controlled as it exits the outlet end of the nozzle and more precise gunning and a reduction in drip and rebound are provided. Shown in FIG. 4 is an end view of a hollow flange 40 as viewed looking at the outlet end of nozzle 2.

Figure 5:
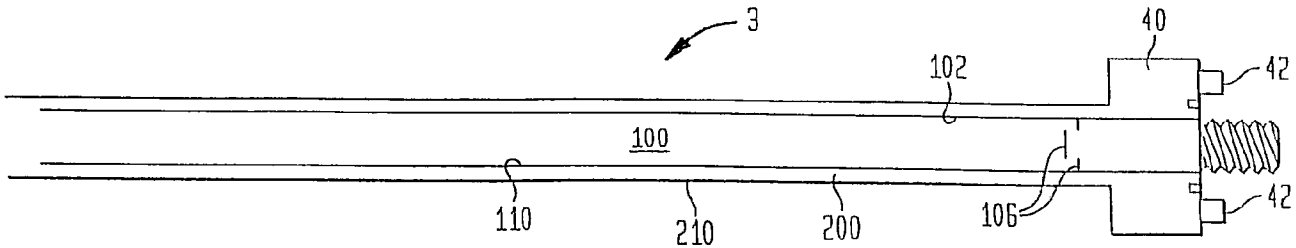
FIG. 5 is a sectional view of an alternate nozzle embodiment according to the present invention.
Figure 7:
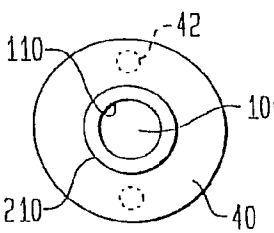
FIG. 7 is an end view of the outlet end of the nozzle shown in FIG. 5.
Figure 6:
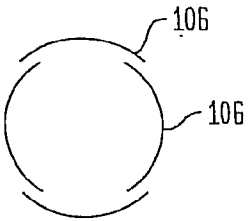
FIG. 6 is a schematic representation illustrating a preferred overlapping orientation of the ends of circumferential slots located in the nozzle shown in FIG. 5.

According to another embodiment of the present invention, shown in FIG. 5 is yet another embodiment of a nozzle 3 according to the present invention, wherein a plurality of through slots 106 is located circumferentially in the inner tubular member 110 near the inlet end 102. These slots may be located at any position within the inner tubular member. Shown in FIG. 6 is a schematic representation illustrating a preferred overlapping orientation of the ends of each of the circumferential slots 106. Shown in FIG. 7 is an end view of hollow flange 40 as viewed looking at the outlet end of nozzle 3.

Figure 8:
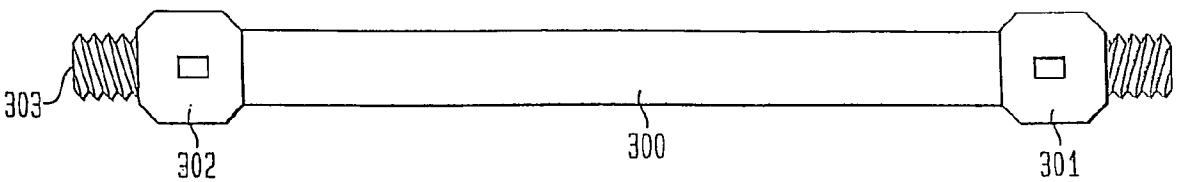
FIG. 8 is a view of an alternate gunning device embodiment according to the present invention.

FIG. 8 illustrates yet another embodiment of an apparatus for the gunning of a material according to the present invention in which a tubular member 300 is used in conjunction with a gas mixing chamber 301 located at the inlet end of the tubular member 300 and a gas inlet chamber 302 is located at an outlet end 303 of the tubular member. The combination of the mixing chamber 301 and the gas inlet chamber 302 acts to enhance the mixing and consolidation of the material and water prior to reaching the outlet end. The tubular member 300 can be used in conjunction with any of the nozzles described above attached at its outlet end 303.

Figure 9:
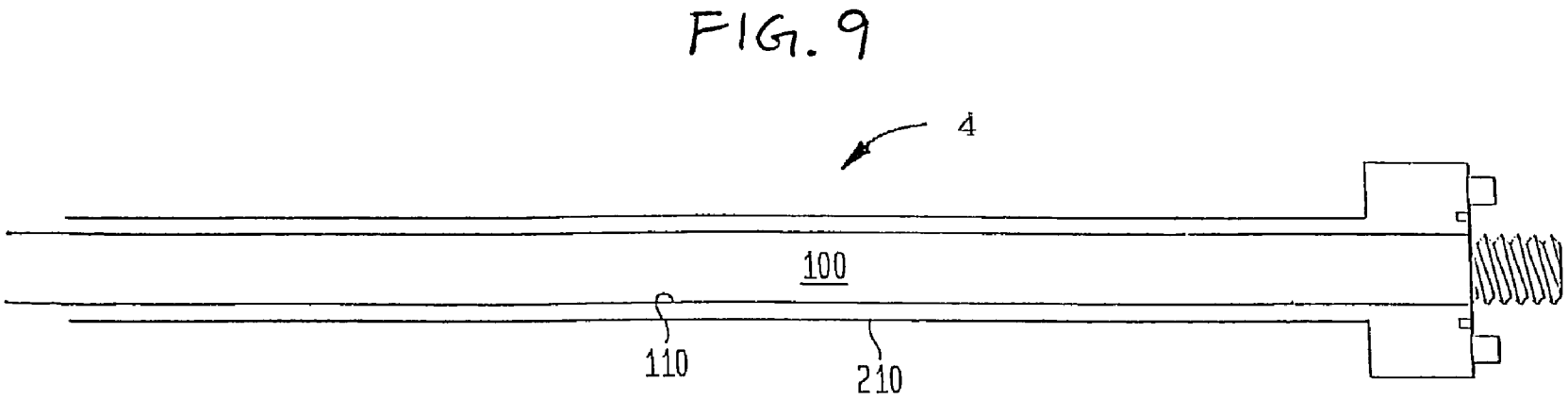
FIG. 9 is a sectional view of an alternate nozzle embodiment according to the present invention.

According to another embodiment of the present invention, shown in FIG. 9 is an alternate embodiment of a nozzle 4 according to the present invention, wherein the inner tubular member 110 is longer than the outer tubular member 210. In this embodiment the inner tubular member can extend from about ¼ of an inch to about 1 inch past the outer tubular member. In this fashion, the spray of the gunning material is controlled as it exits the outlet end of the nozzle and more precise gunning and a reduction in drip and rebound are provided.

Figure 10:
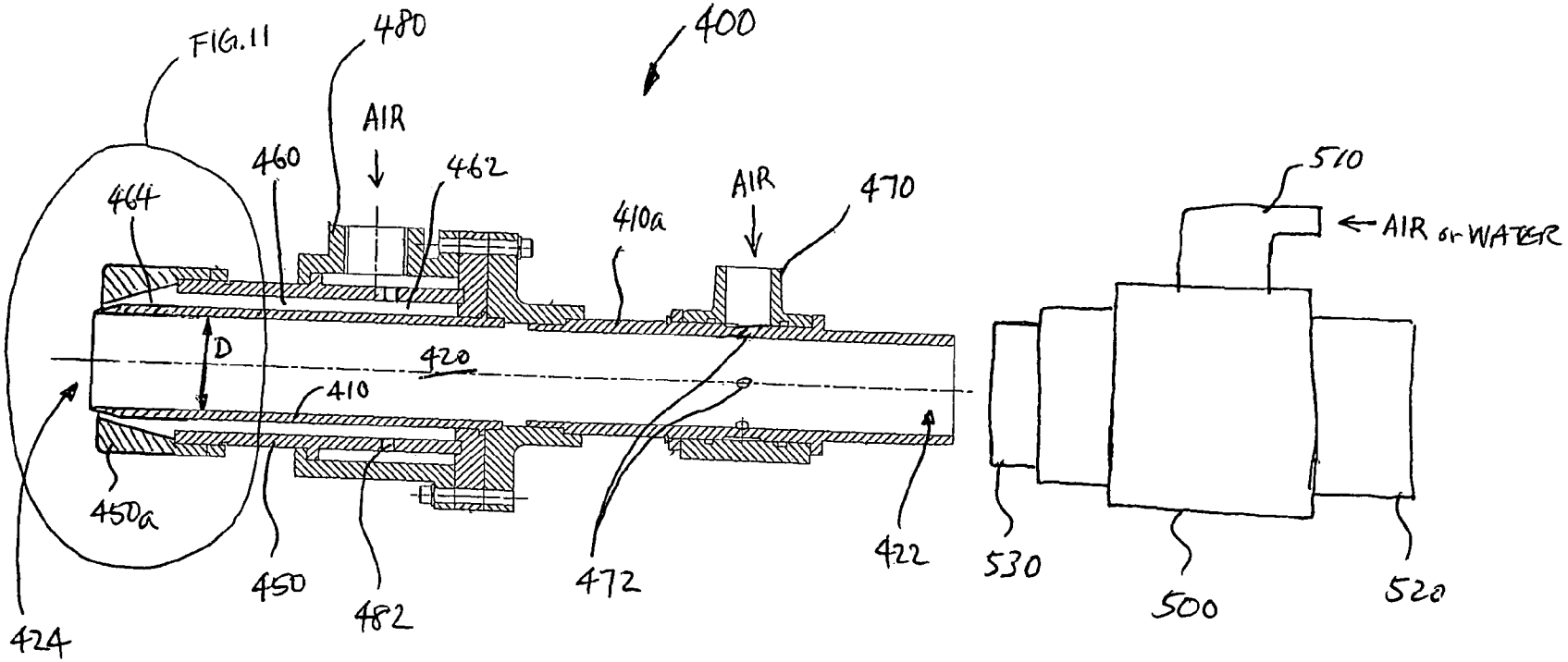
FIG. 10 is a sectional view of another embodiment of a nozzle according to the present invention.

FIG. 10 is an illustration of another embodiment of a gunning nozzle 400 according to the present invention. The nozzle 400 is generally optimal for gunning of wetted aggregate material whether the material is wet-mix material or dry-mix material that is wetted with a supply of water as the dry material enters the nozzle such as in the embodiment shown in FIG. 1. The nozzle 400 includes an inner tubular member 410 which defines an inner passage 420. The inner passage has an inlet end 422 into which a wetted material enters the nozzle 400 and an outlet end 424 from which the wetted material exits during gunning/spraying operation.

An outer tubular member 450 is disposed around the inner tubular member 410 and defines an outer passage 460 between the inner tubular member 410 and the outer tubular member 450. The outer tubular member 450 is sufficiently long to extend towards and close to the outlet end 424 of the inner passage 420 defined by the inner tubular member 410. The space between the outer tubular member 450 and the inner tubular member 410 near the outlet end 424 defines outlet end 464 of the outer passage 460.

The outer passage 460 has an inlet end 462 for introducing a compressed gas of appropriate pressure, such as air, to be passed through the outer passage and exit through the outlet end 464. The compressed air exiting the outlet end 464 impinges on the gunning stream of wetted material exiting the outlet end 424 of the inner passage 420.

The compressed gas for impinging on the gunning stream is supplied via a first gas supply port 480 provided near the inlet end 462 and fitted on the outer tubular member 450. The gas supply port 480 is in fluid communication with the outer passage 460 via one or more holes 482 provided near the inlet end 462 of the outer tubular member 450. In a wet-mix, i.e. shotcrete-type, gunning operation in which the wetted material is being gunned at about 4-12 tons per hour through a nozzle whose inner tubular passage 420 has a diameter of about 2 inches to a target surface at about 6 feet away, the impinging compressed air is supplied at about 125-375 standard cubic-feet per minute ("SCFM") and preferably at about 250 SCFM. The amount of compressed gas supplied here will vary depending on the type of the material, flow rate of the material, the diameter of the inner passage, and the gunning distance, etc.

In this embodiment, the inlet end 422 of the inner tubular member 410 extends upstream (with respect to the flow of the wetted material in the nozzle 400) further than the outer tubular member 450. A second gas supply port 470 is provided in this section of the inner tubular member 410. The second gas supply port 470 is provided in conjunction with a plurality of through slots or holes 472 in the inner tubular member 410 to introduce or inject a supply of compressed gas of appropriate pressure, such as air, into the inner passage 420 for the purpose of accelerating the velocity of the wetted material flowing through the inner passage 420. To achieve this function, the plurality of through holes 472 are oriented at an angle, as shown, so that the gas flowing through the holes 472 into the inner passage 420 are directed towards the outlet end 424 of the inner passage 420. The plurality of through holes 472 would generally be positioned circumferentially in the inner tubular member as shown. The number and size of the through holes 472 will vary depending upon the diameter D of the inner passage 420 and the particular gunning material flowing through the inner passage 420. The amount of compressed gas supplied through the through holes 472 will depend on the particular application. For wetted material being gunned at about 4-12 tons per hour through a nozzle having about 2 inch diameter inner tubular passage 420 to a target surface about 6 feet away, about 200-400 SCFM of compressed gas would be supplied and preferably about 350 SCFM.

The inner tubular member 410 may be provided in a single piece unit extending the full length from the outlet end 424 to the inlet end 422 or optionally, the inner tubular member 410 may be provided as a multiple-piece component if appropriate. For example, in the embodiment illustrated in FIG. 10, the inner tubular member 410 is provided in two pieces. The back half or the portion 410*a* defining the inlet end 422 of the inner passage 420 is a separate piece from the rest of the inner tubular member 410. Such sectioning may be necessitated by the reasons of easy assembly etc. and does not affect the function of the nozzle 400.

In further variation of the nozzle 400, the plurality of through holes 472 may be positioned in the portion of the inner tubular member 410 that is within the outer passage 460. In that embodiment the gas supplied through the first gas supply port 480 will supply the gas for the accelerating as well as the impinging functions. This configuration is similar to the embodiment shown in FIG. 5 in which through slots 106 are provided in the inner tubular member 110 near its inlet end.

Furthermore, an optional processing unit 500 may be used in conjunction with the nozzle 400 to provide appropriate preprocessing of the gunning material before entering the nozzle 400 depending on the particular gunning application. The optional processing unit 500 has an inlet end 520 and an outlet end 530. The gunning material will enter via the inlet end 520 and exit via the outlet end 530. The outlet end 530 would be configured and adapted to appropriately fitted to the inlet end 422 of the nozzle 400. For example, if the nozzle 400 is used in a dry-mix gunning application, i.e., gunnite-type, the optional processing unit 500 provided upstream may be a water mixing unit where water is supplied through its inlet port 510 and the optional processing unit 500 would be appropriately configured inside to appropriately wet the dry gunning material into a wet-mix material that can be gunned/sprayed with the nozzle 400. On the other hand, if the nozzle 400 is used in a wet-mix gunning application, i.e. shotcrete-type, the optional processing unit 500 shreds the wet-mix gunning material using gas, such as air, to achieve appropriate viscosity of the wet-mix gunning material before entering the nozzle 400. In that example, compressed gas of appropriate pressure would be supplied through the inlet port 510 of the optional processing unit 500.

In this embodiment, the outer tubular member 450 and the inner tubular member 410 at the outlet ends 464, 424 are configured in a particularly desired way to optimize the impinging function of the gas flowing through the outer passage 460. This configuration will now be discussed in further detail in reference to FIG. 11. As shown in the detailed schematic of FIG. 11, the inner tubular member 410 near the outlet end 424 of the inner passage 420 extends or protrudes out further than the outer tubular member 450. The leading edge 415 of the inner tubular member 410 is shown as protruding out by a distance P. The inner tubular member 410 has an inner surface 412 and an outer surface 413 and the outer surface 413 near the outlet end 424 is chamfered at an angle θ with respect to the longitudinal axis of the inner tubular member 410. The outer tubular member 450 has an inner surface 452 and an outer surface 453 and the inner surface 452 near the outlet end 464 of the outer passage 460 is chamfered at the same angle θ and thus parallel to the chamfered outer surface 413 of the inner tubular member 410. The gap between the chamfered surfaces of the inner tubular member 410 and the outer tubular member 450 is represented by G. Thus, the compressed gas exiting the outlet end 464 of the outer passage 460 will be at the angle θ and that angle is selected to provide the optimal impingement of the gunning material exiting the inner passage 420 by the gas to control the spray pattern of the gunning material minimizing unwanted rebound, drip, etc. Through the improved control of the spray pattern, the wetted material can be gunned/sprayed further than the conventional nozzles while maintaining the desired spray pattern.

Figure 11:
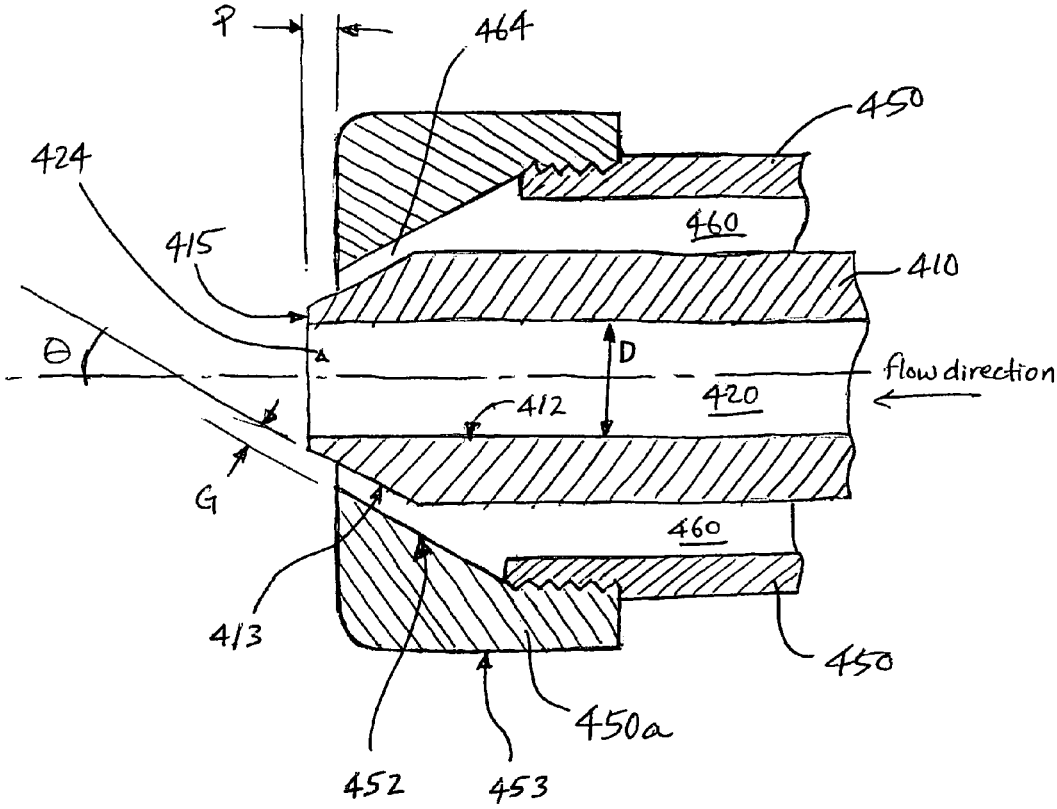
FIG. 11 is a detailed sectional view of the tip of the nozzle of FIG. 10.

Furthermore, as shown in FIGS. 10 and 11, the diameter D of the inner passage 420 is constant, i.e. not constricted as in the conventional polyurethane nozzle tips used in shotcrete applications. This constant diameter D allows unrestricted flow of the wetted gunning material and eliminates the concern of blockage of the nozzle often experiences with the conventional polyurethane shotcrete nozzles.

To maintain the optimal geometric relationship between the impinging air exiting the outer passage 460 and the wetted gunning material exiting the inner passage 420, the thickness of the leading edge 415 of the inner tubular member and the dimensions P, θ and G must be controlled. For an application where wetted material is being pumped through the inner passage 420 having a diameter D of about 2 inches at about 4-12 tons per hour to a target surface at about 6 feet away, the following values for dimensions provide the optimal spray pattern. The leading edge 415 of the inner tubular member is at least 1/16 inch. The chamfer angle θ can be between about 5° and 60° and preferably about 30° with respect to the longitudinal axis of the inner tubular member 410. The leading edge 415 of the inner tubular member 410 protrudes about 1/4 to 1/32 inch when the gap G between the chamfered surfaces of the inner tubular member 410 and the outer tubular member 450 is about 0.01 to 0.1 inch. Preferably, the leading edge 415 protrudes at least about 1/16 inch and the gap G at the outlet end 464 of the outer passage 460 is about 0.02 inch.

Furthermore, the outer tubular member 450 may be a single-piece unit but alternatively the outer tubular member may be configured to be in multiple pieces near the outlet end 464 of the outer passage 460 as shown in FIG. 11. In the embodiment of FIG. 11, the outer tubular member 450 comprises an adjustable collar piece 450*a* that includes the chamfered inner surface 452. The collar piece 450*a* may be configured to threadably engage the main portion of the outer tubular member 450 so that the collar piece 450*a* can be adjusted in and out along the longitudinal axis of the inner tubular member 410. This will allow fine adjustment of the gap G of the outlet end 464 of the outer passage 460 even during gunning/spraying of the wetted material.

While embodiments and applications of this invention have been shown and described, it will be apparent to those skilled in the art that more modifications are possible without departing from the inventive concepts herein described. It is understood, therefore, that the invention is capable of modification and therefore is not to be limited to the precise details set forth. Rather, various modifications may be made in the details within the scope and range of equivalents of the claims without departing from the spirit of the invention. It is envisioned that this apparatus can be used in the shotcrete method of material placement. It is also envisioned that this apparatus can be used in applications outside of those for fabricating or repairing refractory linings.

While the foregoing invention has been described with reference to the above embodiments, various modifications and changes can be made without departing from the spirit of the invention. Accordingly, all such modifications and changes are considered to be within the scope of the appended claims.

We claim:

1. A refractory concrete gunning apparatus for the gunning of a wetted dry mix or wet mix refractory concrete gunning material comprising:

a nozzle having an inner passage wherein the inner passage has an inlet end, into which a wetted dry mix or wet mix refractory concrete gunning material is to be introduced, the inlet end being dimensioned and configured for the introduction of the wetted dry mix or wet mix and an outlet end from which the wetted dry mix or wet mix refractory concrete gunning material is to be sprayed, wherein the inner passage is defined by an inner tubular member and has a substantially constant diameter; and an outer passage defined by an outer tubular member disposed around the inner tubular member and in fluid communication therewith, the outer tubular member having an inlet end for introducing a gas to be passed through the outer passage and an outlet end from which the gas exits and impinges on the wetted dry mix or wet mix refractory concrete gunning material exiting the outlet end of the inner passage, the inner tubular member and the outer tubular member each having an inner surface and an outer surface, wherein the inner tubular member comprises a plurality of through slots circumferentially arranged near the inlet end and connecting the outer passage with the inner passage allowing the outer passage and the inner passage to be in fluid communication to deliver a portion of the gas from outer passage to the inner passage for accelerating the wetted dry mix or wet mix refractory concrete gunning material through the inner passage, and further wherein the outlet end of the inner tubular member extends beyond the outlet end of the outer tubular member and the outer surface of the outlet end of the inner tubular member is chamfered and the inner surface of the outlet end of the outer tubular member is chamfered at a same angle.

2. The refractory concrete gunning apparatus according to claim 1, wherein the inner tubular member extends beyond the outlet end of the outer tubular member by about 1/4 to 1/32 inch and the outlet end of the outer passage is about 0.01 to 0.1 inch wide.

3. The refractory concrete gunning apparatus according to claim 1, wherein the inner tubular member extends beyond the outlet end of the outer tubular member by at least about 1/16 inch and the outlet end of the outer passage is about 0.02 inch wide.

4. The refractory concrete gunning apparatus according to claim 1, wherein the chamfer angle is at least about 5° and less than 60° with respect to the longitudinal axis of the inner tubular member.

5. The refractory concrete gunning apparatus according to claim 1, wherein the chamfer angle is at least about 30° with respect to the longitudinal axis of the inner tubular member.

6. The refractory concrete gunning apparatus according to claim 1, further comprising an optional processing unit in fluid communication with the inlet end of the inner passage.

7. The refractory concrete gunning apparatus according to claim 6, wherein the optional processing unit is a water mixing unit.

8. The refractory concrete gunning apparatus according to claim 6, wherein the optional processing unit shreds the wetted material.

9. A refractory concrete gunning apparatus for the gunning of a wetted dry mix or wet mix refractory concrete gunning material comprising:

a nozzle having an inner passage wherein the inner passage has an inlet end into which a wetted dry mix or wet mix refractory concrete gunning material is to be introduced, the inlet end being dimensioned and configured for the introduction of the wetted dry mix or wet mix and an outlet end from which the wetted dry mix or wet mix refractory concrete gunning material to be sprayed, wherein the inner passage is defined by an inner tubular member and has a substantially constant diameter; and an outer passage defined by an outer tubular member disposed around the inner tubular member and in fluid communication therewith, the outer tubular member having an inlet end for introducing a gas to be passed through the outer passage and an outlet end from which the gas exits and impinges on the wetted dry mix or wet mix refractory concrete gunning material exiting the outlet end of the inner passage, the inner tubular member and the outer tubular member each having an inner surface and an outer surface, wherein the inner tubular member comprises a plurality of through holes circumferentially arranged near the inlet end to deliver a gas to the inner passage for accelerating the wetted dry mix or wet mix refractory concrete gunning material through the inner passage, and further wherein the outlet end of the inner tubular member extends beyond the outlet end of the outer tubular member and the outer surface of the outlet end of the inner tubular member is chamfered and the inner surface of the outlet end of the outer tubular member is chamfered at a same angle.

10. The refractory concrete gunning apparatus according to claim 9, wherein the inner tubular member extends beyond the outlet end of the outer tubular member by about ¼ to 1/32 inch and the outlet end of the outer passage is about 0.01 to 0.1 inch wide.

11. The refractory concrete gunning apparatus according to claim 9, wherein the inner tubular member extends beyond the outlet end of the outer tubular member by at least about 1/16 inch and the outlet end of the outer passage is about 0.02 inch wide.

12. The refractory concrete gunning apparatus according to claim 9, wherein the chamfer angle is at least about 5° and less than 60° with respect to the longitudinal axis of the inner tubular member.

13. The refractory concrete gunning apparatus according to claim 9, wherein the chamfer angle is at least about 30° with respect to the longitudinal axis of the inner tubular member.

14. The refractory concrete gunning apparatus according to claim 9, further comprising an optional processing unit in fluid communication with the inlet end of the inner passage.

15. The refractory concrete gunning apparatus according to claim 14, wherein the optional processing unit is a water mixing unit.

16. The refractory concrete gunning apparatus according to claim 14, wherein the optional processing unit shreds the wetted dry mix or wet mix refractory concrete gunning material.

17. The refractory concrete gunning apparatus according to claim 9, wherein the chamfer angle is at least about 30° and less than 60° with respect to the longitudinal axis of the inner tubular member.

* * * * *